US005950397A

United States Patent [19]

Ginn et al.

[11] Patent Number: 5,950,397

[45] Date of Patent: Sep. 14, 1999

[54] BUILDING PANELS

[75] Inventors: Mary Rowena Ginn; Francis John Wood, both of Rangiora; Ian Philip McKay, Blenheim, all of New Zealand

[73] Assignee: Mary Rowena Ginn and Francis John Wood, Rangiora, New Zealand

[21] Appl. No.: 08/860,063

[22] PCT Filed: Dec. 20, 1995

[86] PCT No.: PCT/NZ95/00134

§ 371 Date: Jun. 20, 1997

§ 102(e) Date: Jun. 20, 1997

[87] PCT Pub. No.: WO96/19622

PCT Pub. Date: Jun. 27, 1996

[30] Foreign Application Priority Data

Dec. 20, 1994 [NZ] New Zealand ..... 270213

[51] Int. Cl.[6] ..... E04B 2/34

[52] U.S. Cl. ..... 52/742.14; 52/747.1; 52/436; 52/437; 52/439; 52/505; 52/561; 52/607; 52/604; 52/592.6

[58] Field of Search ..... 52/425, 436–439, 52/309.7, 309.12, 309.16, 309.17, 604, 605, 607, 592.6, 378, 503, 504, 565, 561

[56] References Cited

U.S. PATENT DOCUMENTS

| | | | |
|---|---|---|---|
| 1,970,414 | 8/1934 | Brown | 52/505 X |
| 2,634,602 | 4/1953 | Zagray | 52/436 |
| 2,882,715 | 4/1959 | Zagray | 52/346 |
| 2,994,162 | 8/1961 | Frantz | 52/437 X |
| 3,387,421 | 6/1968 | Robertson | 52/436 X |
| 3,534,518 | 10/1970 | Zagray | 52/436 |
| 3,552,076 | 1/1971 | Gregori | 52/309.12 |
| 3,782,049 | 1/1974 | Sachs | 52/592.6 X |
| 4,075,808 | 2/1978 | Pearlamn | 52/439 |
| 4,295,313 | 10/1981 | Rassias | 52/436 X |
| 4,473,985 | 10/1984 | Hunt | 52/592.6 |
| 4,485,604 | 12/1984 | Palamara et al. | 52/436 |
| 4,567,698 | 2/1986 | Morrison . | |
| 4,860,515 | 8/1989 | Browning | 52/439 X |
| 4,967,528 | 11/1990 | Doran | 52/309.12 |
| 5,056,577 | 10/1991 | DeLong et al. . | |
| 5,065,561 | 11/1991 | Mason . | |
| 5,231,813 | 8/1993 | Drawdy | 52/309.12 |
| 5,454,199 | 10/1995 | Blom et al. | 52/309.17 X |
| 5,465,542 | 11/1995 | Terry | 52/309.12 X |
| 5,485,703 | 1/1996 | Nordahl | 52/607 X |

FOREIGN PATENT DOCUMENTS

| | | | |
|---|---|---|---|
| 138278 | 7/1948 | Australia . | |
| 27525/77 | 2/1979 | Australia . | |
| 29012/77 | 3/1979 | Australia . | |
| 77149/91 | 11/1991 | Australia . | |
| 64645/94 | 12/1994 | Australia . | |
| 38 32 498 | 4/1990 | Germany . | |
| 26545 | 12/1898 | United Kingdom | 52/505 |
| 526171 | 9/1940 | United Kingdom | 52/437 |
| WO 85/02216 | 5/1985 | WIPO . | |
| WO 93/21406 | 10/1993 | WIPO . | |

*Primary Examiner*—Robert Canfield
*Attorney, Agent, or Firm*—Merchant & Gould P.C.

[57] ABSTRACT

A building panel (1) has an upper edge (4) adapted to interlock with a lower edge (6) of a vertically adjacent substantially identical panel (1). The lower edge (6) of the panel (1) is adapted to interlock with a vertically adjacent substantially identical panel (1) or base (16). Side edges (8, 9) of the panel (1) are substantially planar to permit abutment of a side edge (8) of one panel (1) against a side edge (9) of a horizontally adjacent substantially identical panel (1). A continuous channel (11) extends the length of each side edge (8, 9) and a further continuous channel (10) extends along the upper edge (4). To construct a wall, a plurality of panels (1) are placed horizontally adjacent to each other to form a lower layer (15). A cementitious mix is poured onto the panels (1) to fill the channels (10, 11). Alternatively, structural members can be placed into the channels (10, 11). A further layer of panels (22) is placed on top of the lower layer (15), and a cementitious mix is again poured into the channels (10, 11). This is repeated until the desired height is acheived.

5 Claims, 7 Drawing Sheets

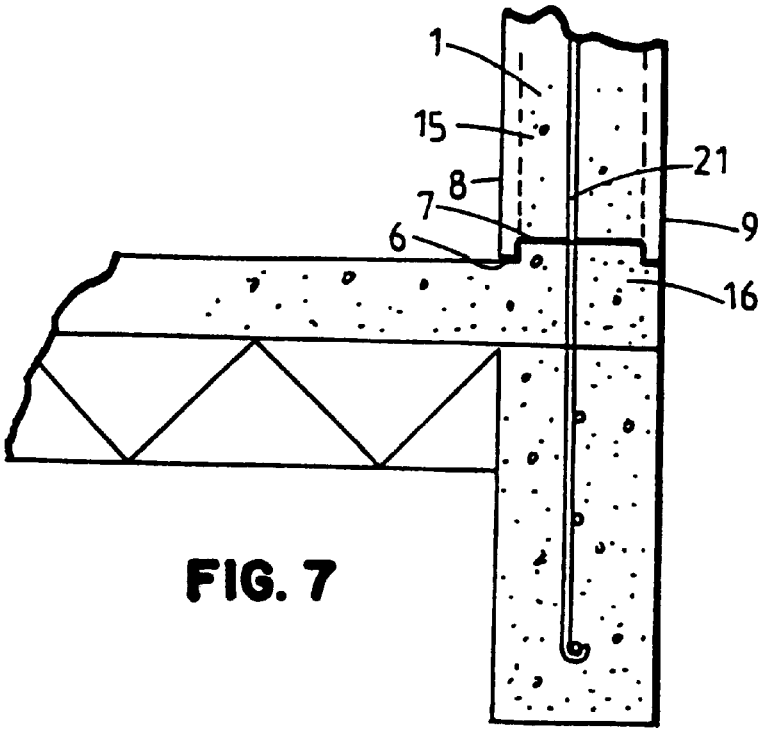
FIG. 7
FIG. 8
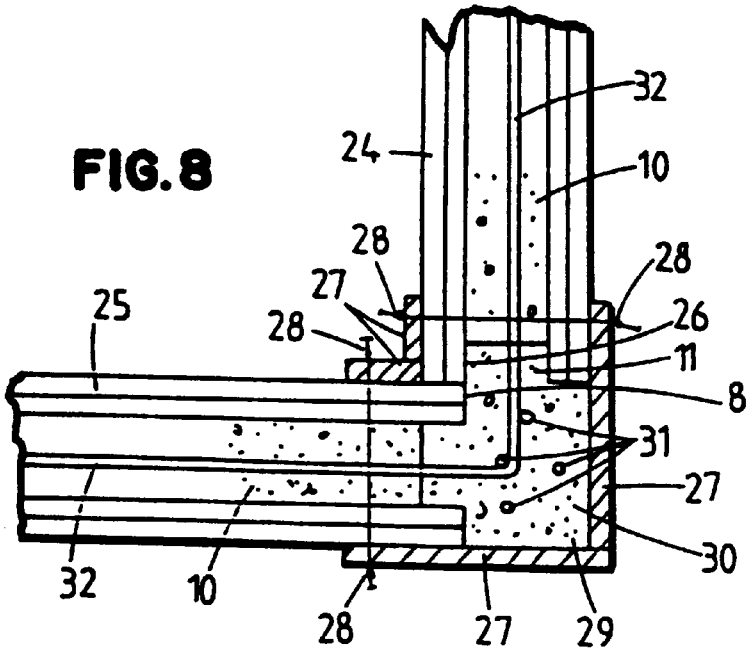

BUILDING PANELS

FIELD OF THE INVENTION

This invention relates lo a method and apparatus employed in building construction, and in particular a form of panel employing the principle of post and beam construction and the method of building using these panels.

BACKGROUND TO THE INVENTION

The cost of timber in building construction can be expensive, and methods of construction employing concrete can require substantial amounts of equipment for bracing and supporting wet concrete during construction.

OBJECTS OF THE INVENTION

Thus, it is an object of the present invention to provide an apparatus and method which allows building construction employing a concrete post and beam construction, which overcomes at least some of the abovementioned problems, or which at least provides the public with a useful alternative.

Other objects of the invention will become apparent from the following description, which is given by way of example only.

BRIEF DESCRIPTION OF INVENTION

According to one aspect of the present invention, there is provided a building panel having an upper edge which is adapted to interlock with a lower edge of a vertically adjacent substantially identical panel, the panel having side edges which are substantially planar to permit abutment of a side edge of one panel against a side edge of an horizontally adjacent substantially identical panel, and wherein a continuous channel extends the length of each side edge and upper edge.

The panel can either be a square or a rectangle. The continuous channel can be formed substantially mid-way between a front face of the panel and a back face of the panel.

In one preferred form of the building panel of the present invention, the depth of the continuous channel on each side edge is between 5% and 10% of the width of the panel.

In a further preferred form of the invention, the depth of the continuous channel in the upper edge is between 10% and 15% of the height of the panel.

Preferably the building panel of this invention is made of a durable, lightweight material, for example polystyrene.

In a preferred form of the invention the building panel can further comprise a diagonal channel interconnecting one end of the continuous channel at a lower part of a side edge with the continuous channel substantially at one end of the upper edge, diagonally opposite the lower part of a side edge.

In a further aspect of the present invention, there is provided a wall incorporating a post and beam construction formed using multiple building panels, wherein each panel has a continuous channel extending the length of each side edge and an upper edge, and wherein the continuous channel of each building panel interconnects with the continuous channel of each adjoining panel in the wall, the channels filled with concrete forming the post and beam construction.

The panel can either be a square or a rectangle. The continuous channel can be formed substantially mid-way between a front face of the panel and a back face of the panel.

In a further aspect of the present invention, there is provided a method of building construction employing building panels, upper edges of which are adapted to interlock with lower edges of vertically adjacent substantially identical panels, and side edges of which are substantially planar to permit abutment of a side edge of one panel against the side edge of an adjacent panel, and wherein a continuous channel extends the length of each side edge and the upper edge, the method comprising:

a) positioning a first layer of abutting panels, wherein the continuous channel in a side edge of one panel is adjacent the continuous channel of a side edge of an adjacent panel forming a post channel, and the continuous channel in the upper edge of each adjacent panel forms a beam channel;

b) pouring wet concrete into the post channels and beam channel of the first layer of panels;

c) positioning a further layer of panels vertically above and aligned with the first layer of panels so that the continuous channels in the side edges of the panels of the further layer form post channels which continue vertically above the post channels of the first layer;

d) pouring wet concrete into the post channels and a beam channel formed in the upper edge of the further layer of panels; and e) repeating steps c) and d) to produce a wall of the required height.

In a preferred form of this aspect of the invention reinforcing rods can be positioned in the post and beam channels during construction.

In a further preferred form of this aspect of the invention, each building panel can further comprise a diagonal channel interconnecting one end of the continuous channel at a lower part of a side edge and a mid-portion of the continuous channel substantially at one end of the upper edge, diagonally opposite the lower part of the side edge, these diagonal channels forming additional strengthening to the walls formed by the method. Preferably, the building panels in each layer of the wall are positioned so that each adjacent panel has the diagonal channel running in an opposite direction.

The panel can either be a square or a rectangle. The continuous channel can be formed substantially mid-way between a front face of the panel and a back face of the panel.

BRIEF DESCRIPTION OF DRAWINGS

Other aspects of the present invention will become apparent from the following description which is given by way of example only, and with reference to the accompanying drawings, in which:

FIG. 7: shows a vertical cross-section through a lower part of a building panel of FIG. 1 adjoining a floor or foundation of a building structure.

FIG. 8: shows a view from above of a corner of a building construction incorporating building panels of the present invention.

DETAILED DESCRIPTION OF DRAWINGS

Figure 1:
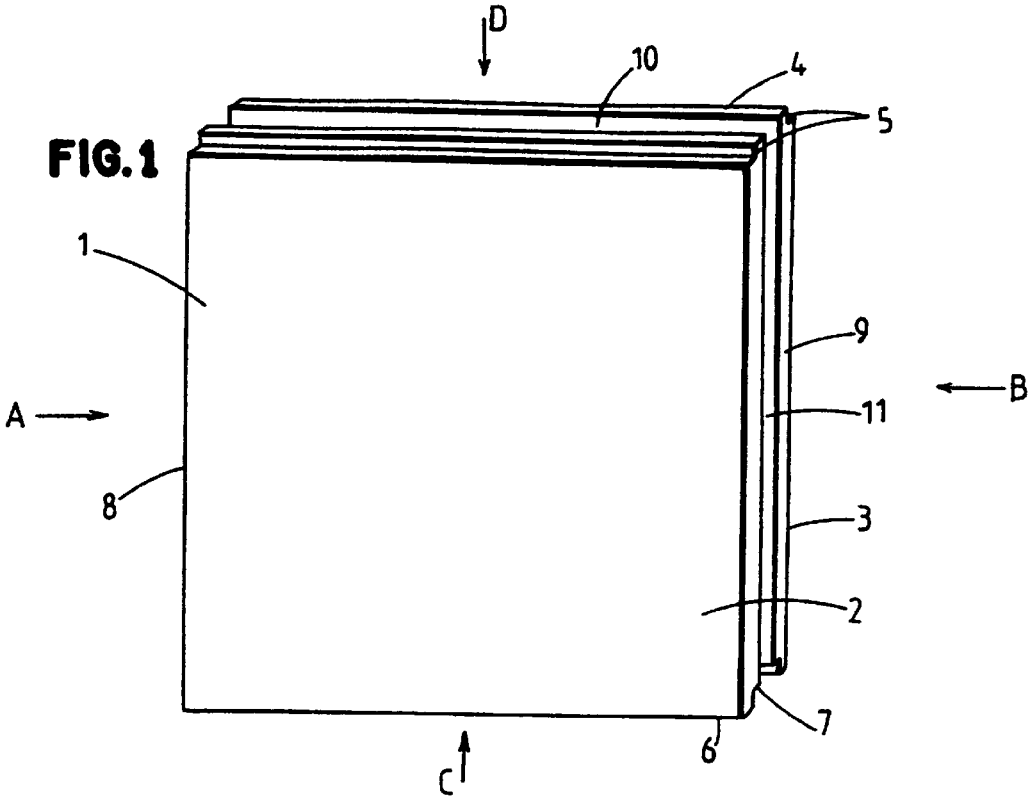
FIG. 1: shows a perspective view of a building panel according to one aspect of the present invention.
Figure 2:
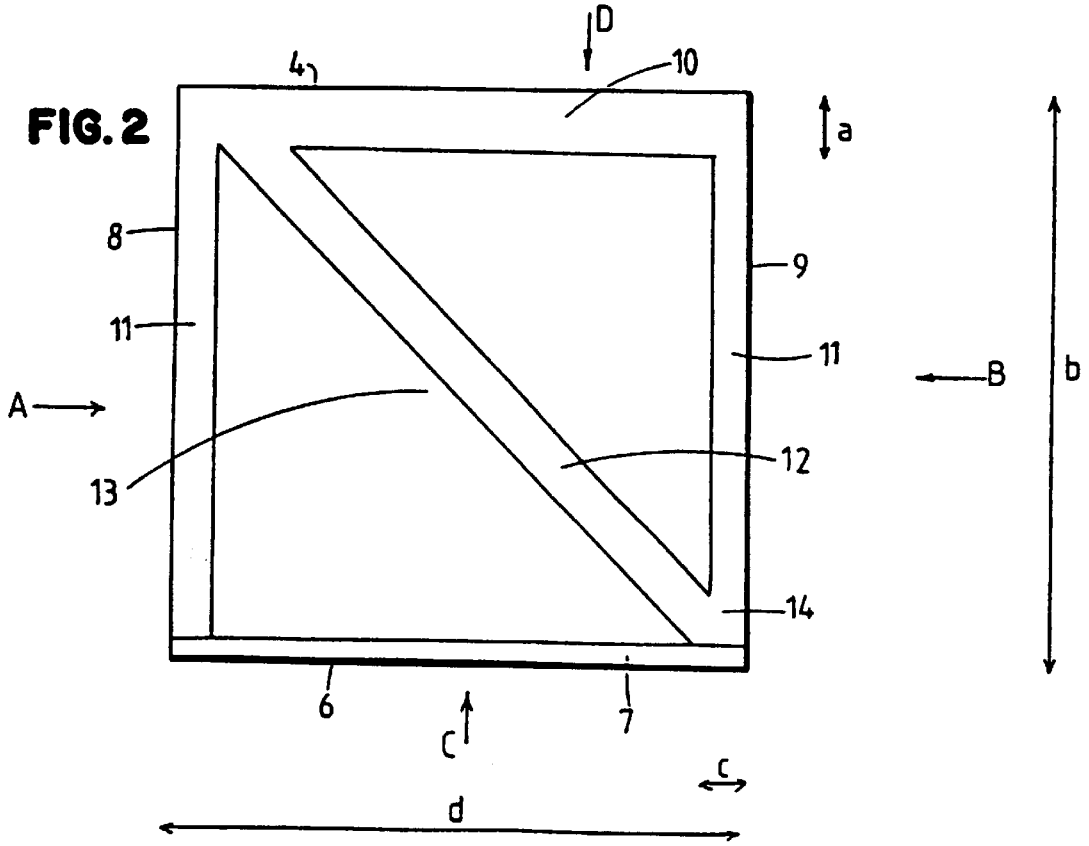
FIG. 2: shows a cross-section through the middle of a building panel of FIG. 1.
Figure 3A:
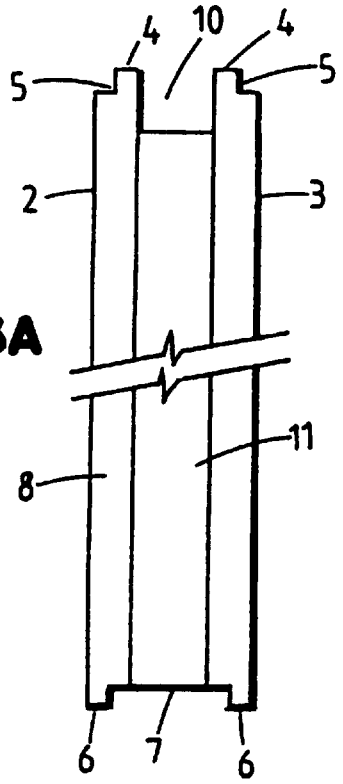
FIG. 3: shows edges of a panel of FIG. 1 from views A, B, C and D.
Figure 3B:
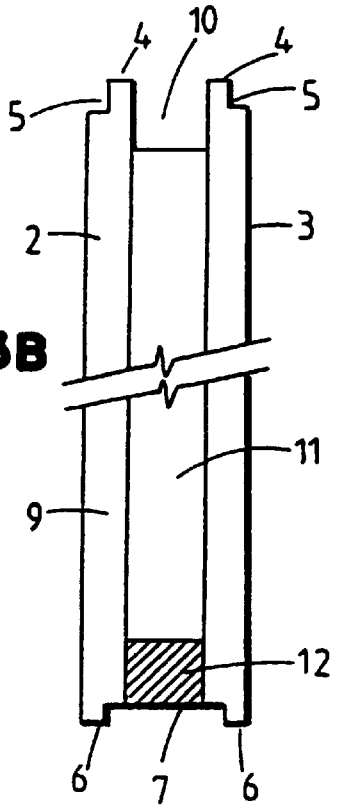
Figure 3D:
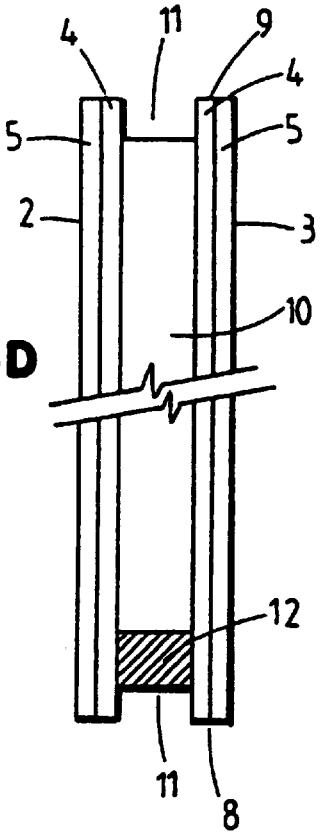
Figure 3C:
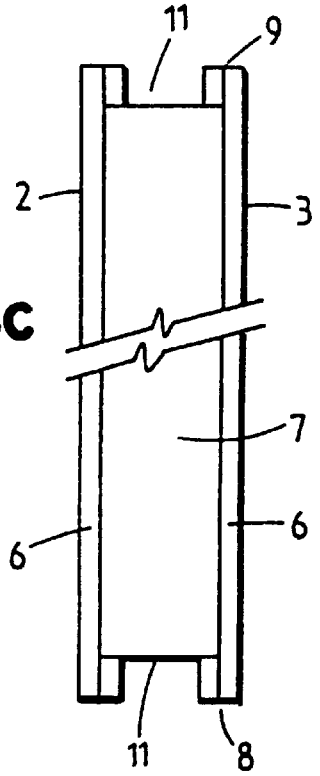

According to a preferred form of the apparatus of the present invention, as shown in FIGS. 1 to 3, there is provided a building panel 1, preferably made of polystyrene. The panel 1 is about 1.2 $m^2$ in the preferred embodiment. However, it will be appreciated that different circumstances may require panels of different sizes, and the scope of the invention is not limited to panels of any particular dimensions.

The front 2 and back 3 surfaces are essentially flat. The upper edge 4 has recessed edges 5 which may form a tongue and groove connection with a bottom edge 6 of another panel, the bottom edge 6 having a recessed portion 7. Side edges 8, 9 are flat, to enable adjacent panels to abut forming substantially flush front and back surfaces.

The top edge 4 includes a central upper channel 10, whilst side channels 11 are formed in the central part of side edges 8, 9. The upper 10 and side 11 channels each has a width substantially 50% of the thickness of the building panel 1.

Referring to FIG. 2, the depth "a" of upper channel 10 is at least 10%, and up to 15%, of the height "b" of a building panel 1. The depth "c" of each side channel 11 is between 5% and 10% of the width "d" of the panel 1.

A diagonal channel 12 passes through the centre 13 of the panel 1 from the upper channel 10 to a lower part 14 of a side channel 11. This diagonal channel 12 is an optional feature where additional strengthening is required.

The method of construction of the present invention, employing the building panels of the invention, is now described.

Figure 4:
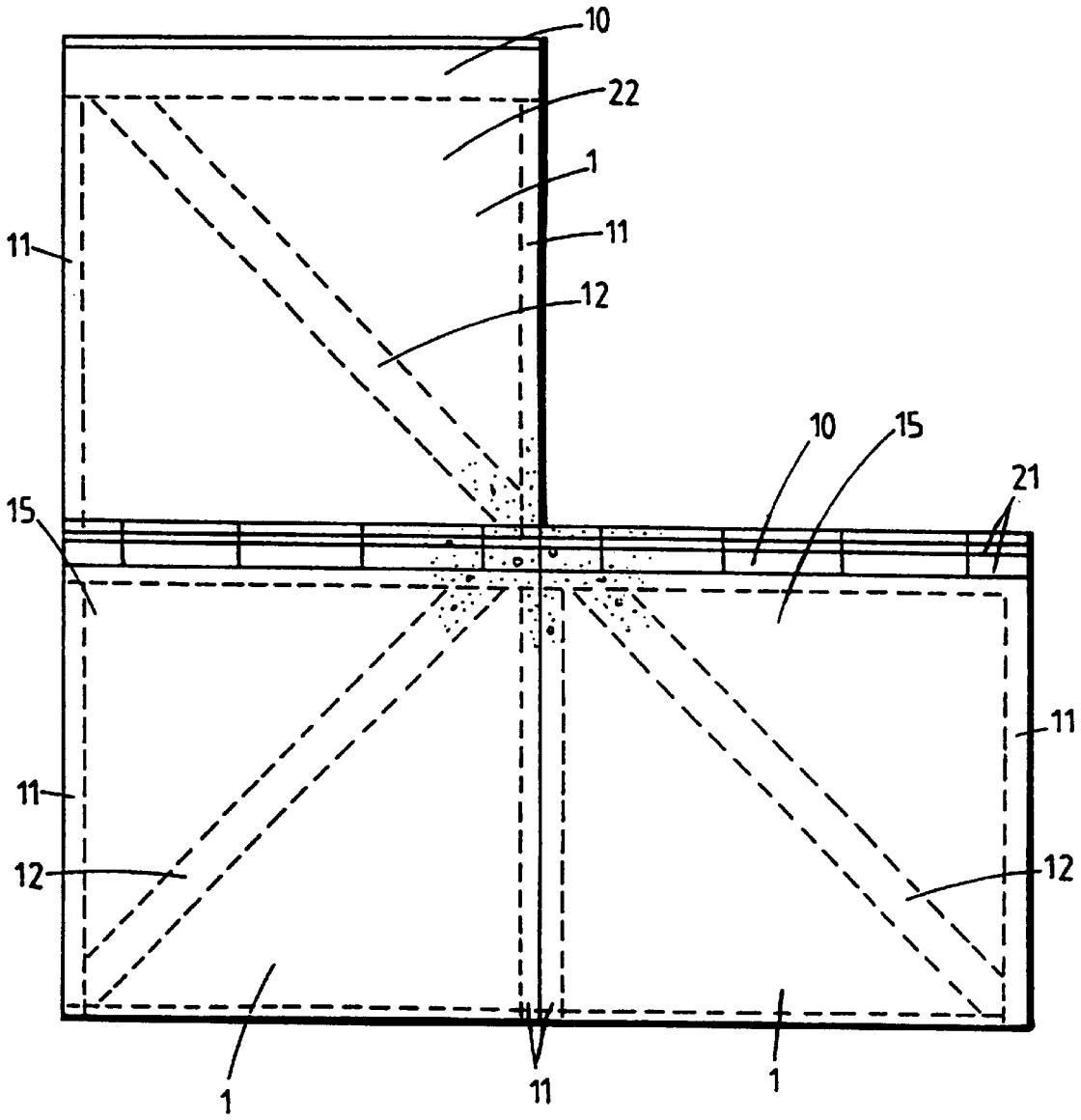
FIG. 4: shows a side view of adjoining building panels of the present invention in a wall construction.
Figure 5:
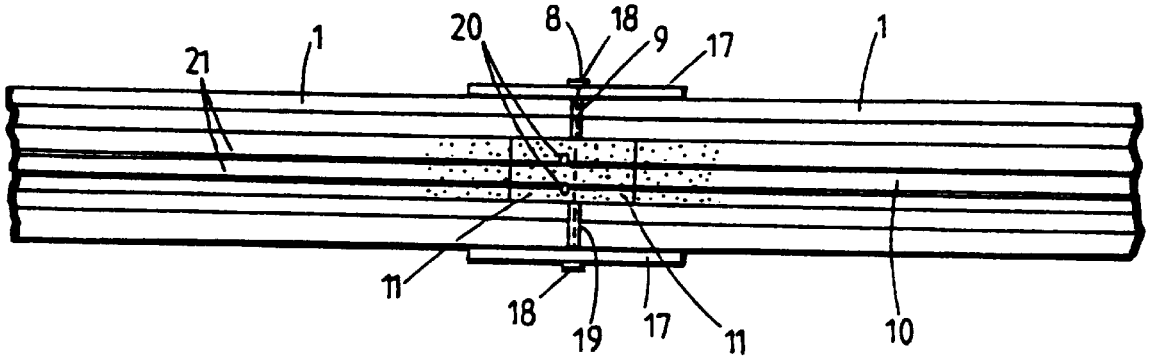
FIG. 5: shows a view from above of two panels of FIG. 1 adjoined in a wall construction.

A wall is constructed employing one layer of building panels at a time. Referring to FIG. 7, a panel 1 of a lower layer 15 of panels is positioned on a preformed base 16. Reinforcing rods 21 may be employed if necessary. A series of panels 1 are positioned on this preformed base 16 side edge 8 to side surface 9, as shown in FIGS. 4 and 5. Adjoining panels are kept aligned using battens 17 tied together by wire 18 passing through the join 19 between the adjacent panels, as shown in FIG. 5.

With the lower layer 15 of panels in position concrete is poured into the upper channel 10 to fill this channel 10 as well as side channels 11 and diagonal channels 12 in each panel 1. Vertically disposed reinforcing rods 20 can be positioned in aide channels 11, and horizontally disposed reinforcing rods 21 can be positioned in upper channel 10, as shown in FIG. 5.

Reinforcing rods can be constructed from timber, steel and the like.

The panels 1 of the lower layer 15 are positioned so that the diagonal channel 12 of each alternate panel runs in the opposite direction, as shown in FIG. 4.

Figure 6:
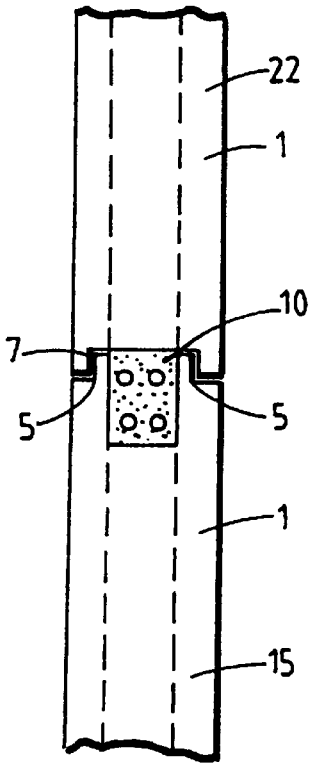
FIG. 6: shows a cross-section through a central part of two panels adjoined vertically in a wall construction.

With the lower layer 15 completed a second layer 22 of panels 1 is positioned on top of the lower layer. Referring to FIGS. 4 and 6, the recessed slot 7 of the bottom edges 6 of the second layer 22 form a tongue and groove connection with the recessed edges 5 of the top edges 4 of the lower layer 15, The panels of the second layer 22 are aligned directly above the panels of the lower layer 15 so that the side channels 11 continue in a substantially vertical post-form. However, as can be seen in FIG. 4, each of the panels of the second layer 22 is inverted in relation to the adjacent panel of the first layer 15 so that the diagonal channels 12 form continuous lines between layers of panels.

Once the new layer of panels is in position more concrete is poured to fill the upper, side and diagonal channels 10, 11, 12 of the new layer.

This process of construction is repeated, as necessary, to complete the wall structure to the required height.

Outer corners are constructed as shown in FIG. 8. One panel 24 is positioned perpendicular to a second panel 25 so that the side edge 8 of panel 25 is substantially aligned with the inner surface 26 of side channel 11 of panel 24. Battens 27, held in place by wires 28 passing through the panels 24, 25 are used to hold the panels 24, 25 in position and form the outer corner 29. The corner post area 30 is therefore filled with concrete at the same time as the channels of the relevant layer of panels. Reinforcing rods may be positioned vertically 31 in the corner post area 30 and horizontally 32 from the upper channel 10 of panel 24, through the corner post area 30 to the upper channel 10 of panel 25.

Figure 9:
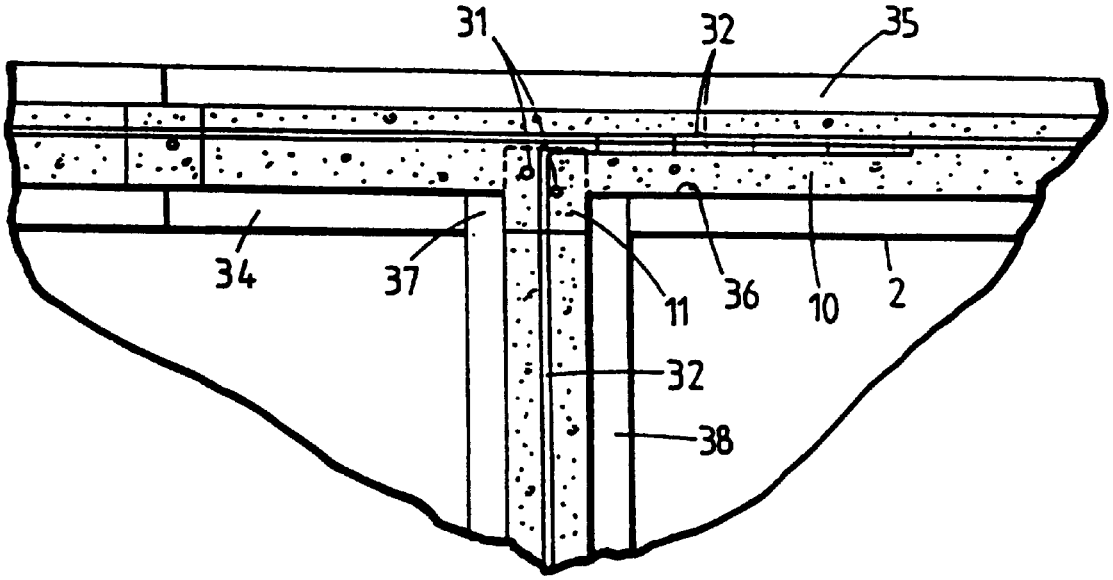
FIG. 9: shows a view from above of an internal wall intersection incorporating building panels of the present invention.

The construction of wall intersections is shown in FIG. 9. A substantially vertical segment the thickness of a panel is cut in the front 2 or back 3 surface of a panel 34 of the main wall of panels 35 to the depth of the inner surface 36 of the upper channel 10. An end 37 of an intersecting panel 38 is slotted into this segment. The side channel 11 of intersecting panel 38 intercepts with the upper channel 10 of panel 34. Vertically 31 and horizontally 32 disposed reinforcing rods may be incorporated.

Figure 10:
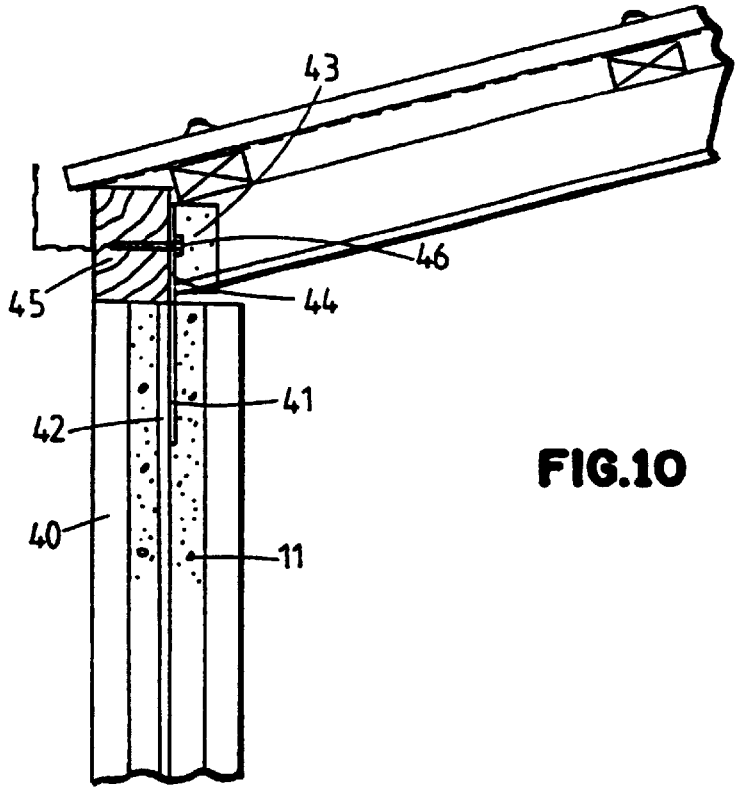
FIG. 10: shows a vertical cross-section through a building panel of the present invention adjoining a roof framing construction.
Figure 11:
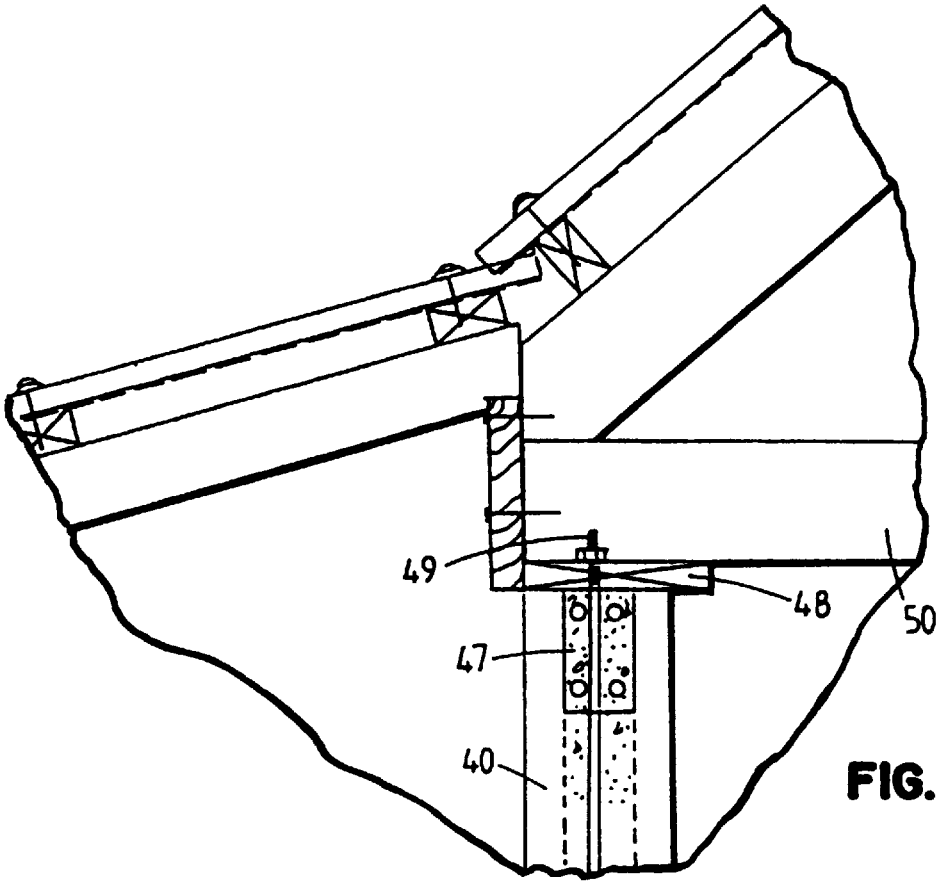
FIG. 11: shows a vertical cross-section through a building panel of the present invention adjoining an alternative roof framing construction.

Roof framing may be affixed to the top layer 40 of panels of a wall construction as shown in FIGS. 10 and 11. In FIG. 10 a galvanised plate "T" bracket 41 is affixed in side channels 11 between adjacent panels. This plate "T" bracket 41 is joined to reinforcing rod 42. A joist hanger 43 is affixed on the protruding part 44 of the plate "T" bracket 41, which is in turn affixed to lintel 45 by coat screw 46.

Alternatively, as shown in FIG. 11, reinforced top channel 47 of the top layer 40 of panels forms the support for pitching plate 48 secured via threaded extensions of vertically disposed reinforcing rods 49. Gang nail truss 50 is supported on pitching plate 48.

The exterior finish of a wall constructed employing building panels of the present invention can be of plaster or other finish, and the interior may optionally include a gib-board finish.

Using the method and apparatus of the present invention multistorey constructions can be built, up to three storeys high.

Thus, employing the building panels of the apparatus of the present invention, the method of the present invention enables the building of walls incorporating a post and beam construction, and this method is adapted to allow internal and external wall connections and roof connections. The method requires no substantial formwork during construction, thus saving building costs.

Although the invention has been described by way of example, and with particular reference to the preferred embodiments shown in the accompanying drawings, it should be appreciated that variations and modifications may be made thereto, without departing from the scope of the invention as herein described. For example, the building panels described are made of polystyrene, but other durable, lightweight materials could also be used. Further, the concrete structures formed in the upper channels and side channels provide horizontal and vertical bracing respectively, of a wall of panels. Diagonal bracing is an optional addition. It is also envisaged that diagonal bracing could be provided in both directions by each panel having a diagonal cross configuration of internal channels.

we claim:

1. A method of building construction employing a plurality of building panels, upper edges of the panels interlocking with lower edges of vertically adjacent substantially identical panels, and side edges of the panels being substantially planar to permit abutment of side edges, and wherein a continuous channel extends the length of each side edge and each upper edge, the method comprising:

(a) positioning a first layer of abutting panels, wherein the continuous channel in the side edge of one panel is adjacent the continuous channel in the side edge of an adjacent panel thereby forming a post channel, and the continuous channel in the upper edge of each adjacent panel forms a beam channel;

(b) placing a reinforcing superstructure into the post channels and the beam channels of the first layer of panels;

(c) positioning a further layer of panels vertically above and aligned with the first layer of panels so the continuous channels in the side edges of the further layer of panels form post channels which continue vertically above the post channels of the first layer, and the continuous channel in the upper edge of each panel in the further layer forms a beam channel;

(d) placing a reinforcing superstructure into the post channels and the beam channels formed in the upper edges of the further layer of panels; and (e) repeating steps (c) and (d) to produce a wall of a required height;

wherein each building panel comprises a diagonal channel interconnecting one end of the continuous channel at a lower part of the side edge and one end of the continuous channel at the upper edge diagonally opposite the lower part of the side edge, wherein the diagonal channels form additional strengthening to the walls formed by the method.

2. A method as claimed in claim 1, further comprising positioning the reinforcing superstructures in the post and beam channels during construction.

3. A method as claimed in claim 2, further comprising constructing the reinforcing superstructures from a group consisting of steel and timber.

4. A method as claimed in claim 2, further comprising using battens held together by wire passing through a joint between the adjacent panels in order to keep the adjacent panels aligned.

5. A method as claimed in claim 1, further comprising positioning the building panels in each layer of the wall so that each adjacent panel has the diagonal channel running in an opposite direction.

* * * * *